US006439695B2

(12) United States Patent
Silverbrook

(10) Patent No.: US 6,439,695 B2
(45) Date of Patent: Aug. 27, 2002

(54) NOZZLE ARRANGEMENT FOR AN INK JET PRINTHEAD INCLUDING VOLUME-REDUCING ACTUATORS

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/900,175

(22) Filed: Jul. 9, 2001

Related U.S. Application Data

(63) Continuation-in-part of application No. 09/112,807, filed on Jul. 10, 1998, now Pat. No. 6,283,581.

(30) Foreign Application Priority Data

Jun. 8, 1998 (AU) ..... PP3991

(51) Int. Cl.[7] ..... B41J 2/015; B41J 2/14; B41J 2/04

(52) U.S. Cl. ..... 347/54; 347/20; 347/48

(58) Field of Search ..... 347/20, 44, 47, 347/54, 68, 48

(56) References Cited

U.S. PATENT DOCUMENTS 4,855,567 A 8/1989 Meuller
5,812,159 A 9/1998 Anagnostopoulos et al.
5,896,155 A 4/1999 Lebens et al.
5,903,380 A * 5/1999 Motamedi et al. ..... 359/224
5,980,719 A * 11/1999 Cherukuri et al. ..... 204/600
6,007,187 A 12/1999 Kashino et al.

FOREIGN PATENT DOCUMENTS

EP 0416540 A2 * 3/1991 ..... 347/54
JP 404001051 A * 1/1992 ..... 347/54

* cited by examiner

*Primary Examiner*—Michael Nghiem
*Assistant Examiner*—An H. Do

(57) ABSTRACT

A nozzle arrangement for an ink jet printhead includes a substrate. An actuator is arranged on the substrate for facilitating the ejection of ink from a nozzle chamber of the nozzle arrangement. The actuator includes a plurality of actuating members that are mounted on the substrate and are operatively positioned with respect to the nozzle chamber to define at least part of one of a roof wall, floor and side wall of the nozzle chamber. The actuating members are displaceable between an inoperative condition and an operative condition to reduce a volume of the nozzle chamber so that ink is ejected from the nozzle chamber. An actuating mechanism is provided for displacing the actuating members between the inoperative and operative conditions.

13 Claims, 6 Drawing Sheets

NOZZLE ARRANGEMENT FOR AN INK JET PRINTHEAD INCLUDING VOLUME-REDUCING ACTUATORS

RELATED US PATENT APPLICATIONS

This is a C-I-P of U.S. Pat. No. 6,283,581.

This application is a continuation-in-part application Ser. No. 09/112,807, filed Jul. 10, 1998 of U.S. Pat. No. 6,283,581. U.S. Pat. Nos. 6,283,581 and 6,234,611 are hereby incorporated by reference.

FIELD OF THE INVENTION

This invention relates to ink jet printheads. More particularly, this invention relates to a nozzle arrangement for an ink jet printhead, the nozzle arrangement including a volume-reducing actuator.

BACKGROUND TO THE INVENTION

The Applicant has invented an ink jet printhead that is capable of generating text and images at a resolution of up to 1600 dpi.

In order to achieve this, the Applicant has made extensive use of micro electro-mechanical systems technology. In particular, the Applicant has developed integrated circuit fabrication techniques suitable for the manufacture of such printheads.

The printheads developed by the Applicant can include up to 84000 nozzle arrangements. Each nozzle arrangement has at least one moving component which serves to eject ink from a nozzle chamber. These components usually either act directly on the ink or act on a closure which serves to permit or inhibit the ejection of ink from the nozzle chamber.

The printheads are manufactured in accordance with an integrated circuit fabrication technique. It follows that the moving components are microscopically dimensioned. This is necessary, given the large number of nozzles per printhead.

Applicant has spent a substantial amount of time developing such moving components in the form of actuators which move within each nozzle chamber to eject ink from the nozzle chamber. A particular difficulty that must be overcome is to achieve sufficient movement of an actuator within the nozzle chamber not only to eject ink but also to ensure that the ink is separated from the remainder of the ink in the chamber to form an ink drop. It follows that sufficient momentum must be imparted to the ink and then directly followed by a reduction in ink pressure in order to create necking of the ink which has been ejected and consequent separation to form an ink drop.

Applicant has conceived the present invention in an attempt to achieve efficient ink ejection and subsequent necking and separation to form the drop.

SUMMARY OF THE INVENTION

According to a first aspect of the invention there is provided a nozzle arrangement for an ink jet printhead, the nozzle arrangement comprising a substrate;

a roof wall, side walls and a floor that define a nozzle chamber; and an actuator that is arranged on the substrate for facilitating the ejection of ink from the nozzle chamber of the nozzle arrangement, the actuator comprising at least one actuating member that is mounted on the substrate and is operatively positioned with respect to the nozzle chamber to define at least part of one of the roof wall, floor and side walls of the nozzle chamber, the, or each, actuating member being displaceable between an inoperative condition and an operative condition to reduce a volume of the nozzle chamber so that ink is ejected from the nozzle chamber; and an actuating mechanism for displacing the, or each, actuating member between the inoperative and operative conditions.

According to a second aspect of the invention, there is provided an ink jet printhead which comprises a substrate;

a plurality of nozzle arrangements positioned on the substrate, each nozzle arrangement comprising a roof wall, side walls and a floor that define a nozzle chamber; and an actuator that is arranged on the substrate for facilitating the ejection of ink from the nozzle chamber of the nozzle arrangement, the actuator comprising at least one actuating member that is mounted on the substrate and is operatively positioned with respect to the nozzle chamber to define at least part of one of the roof wall, floor and side walls of the nozzle chamber, the, or each, actuating member being displaceable between an inoperative condition and an operative condition to reduce a volume of the nozzle chamber so that ink is ejected from the nozzle chamber; and an actuating mechanism for displacing the, or each, actuating member between the inoperative and operative conditions.

The invention is now described, by way of examples, with reference to the accompanying drawings. The specific nature of the following description should not be construed as limiting in any way the broad scope of this summary.

DETAILED DESCRIPTION OF THE DRAWINGS

Figure 1:
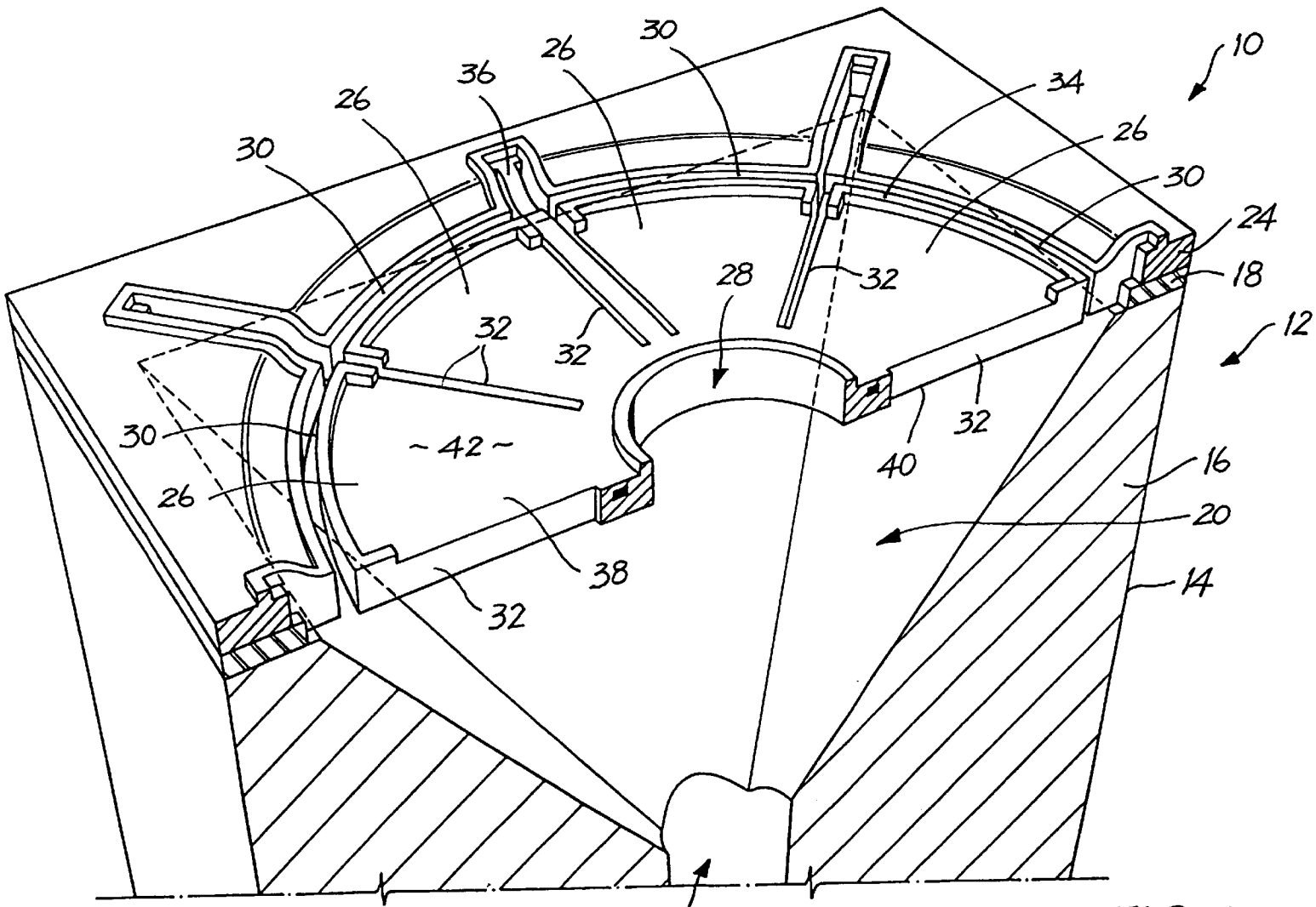
FIG. 1 shows a sectioned, three dimensional view of a first embodiment of a nozzle arrangement, in accordance with the invention, for an ink jet printhead.
Figure 2:
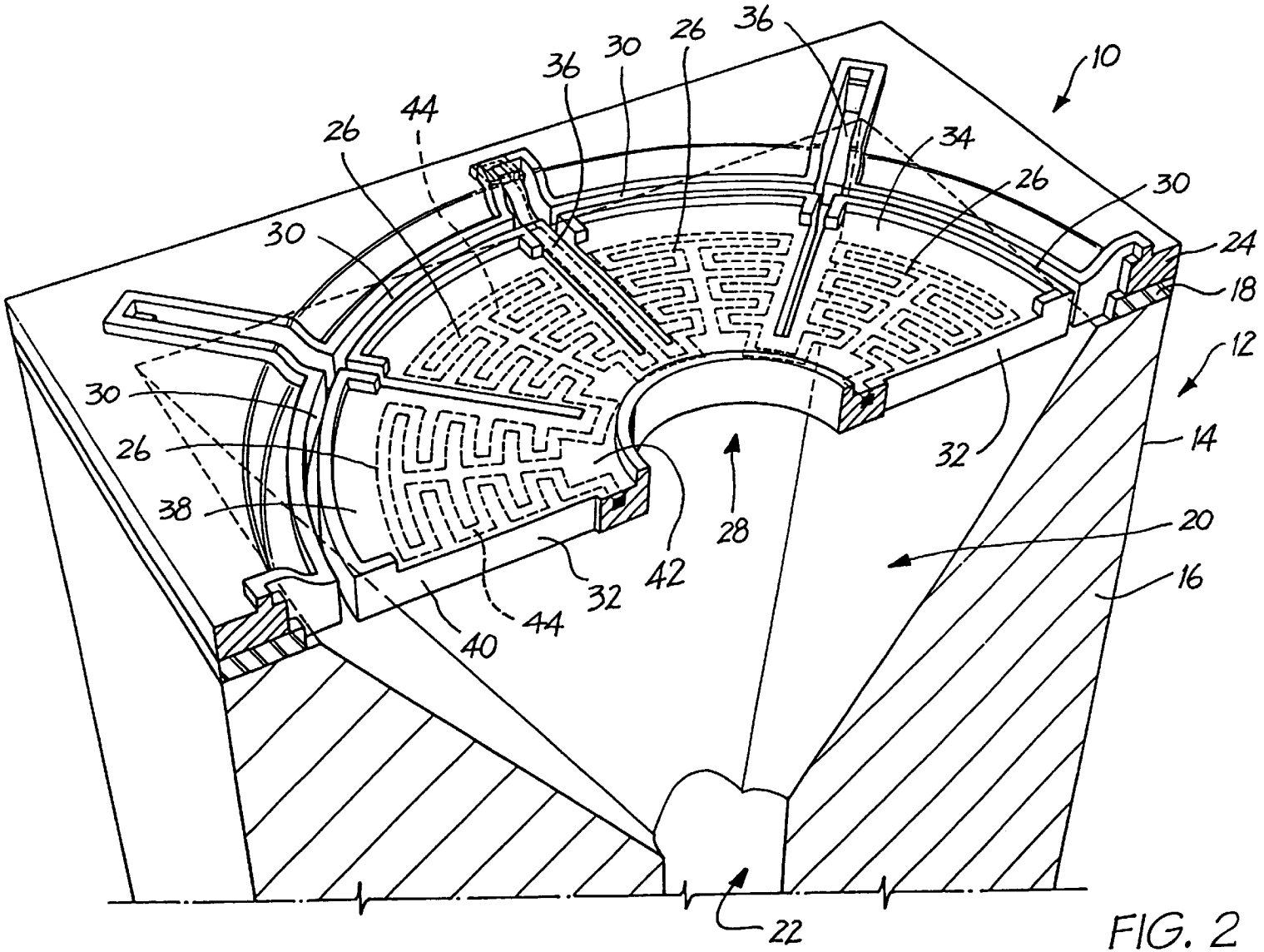
FIG. 2 shows the nozzle arrangement of FIG. 1 including further detail of that nozzle arrangement.

In FIGS. 1 to 7, reference numeral 10 generally indicates a nozzle arrangement, in accordance with the invention, for an ink jet printhead.

The nozzle arrangement 10 is one of a plurality of nozzle arrangements of an ink jet printhead, part of which is indicated at 12.

The ink jet printhead 12 includes a substrate 14. The substrate 14 includes a wafer substrate 16 and a drive circuitry layer 18 positioned on the wafer substrate 16.

The nozzle arrangement 10 includes a nozzle chamber 20 which is etched into the wafer substrate 16. The wafer substrate 16 is also etched to define an ink inlet channel 22 that is in fluid communication with the nozzle chamber 20.

A layer 24 of expansion material is positioned on the drive circuitry layer 18 to span the nozzle chamber 20.

That portion of the layer 24 spanning the nozzle chamber 20 defines a plurality of actuating members 26 and an ink ejection port 28 which are the result of an etching process carried out on the layer 24.

The actuating members 26 are each anchored at a region proximate the ink ejection port 28 and have free, arcuate ends 30. Further, the actuating members 26 have radially extending sides 32. Adjacent sides 32 of consecutive actuating members 26 are spaced to accommodate inward bending movement of the actuating members 26.

As can be seen in the drawings, the actuating members 26 define a circular structure 34.

The expansion material has a coefficient of thermal expansion which is such that upon heating, the material is capable of expansion to an extent sufficient to perform work. In particular, the coefficient of thermal expansion is sufficient so that subsequent movement of the material can be harnessed to perform work.

The layer 24 is etched to define bridging portions 36 which extend towards the ink ejection port 28 to support the actuating members 26 in position above the nozzle chamber 20. As can be seen from the drawings, the actuating members 26 define a roof wall 38 of the nozzle chamber 20. Further, each actuating member 26 has an inner major face 40 and an outer major face 42.

Figure 6:
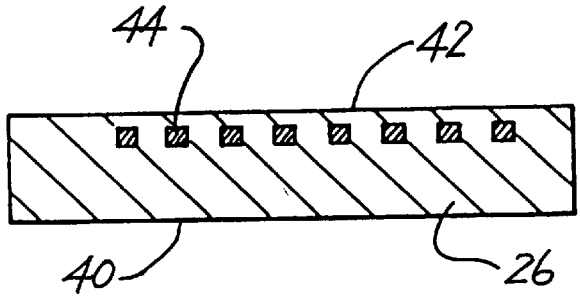
FIG. 6 shows a schematic view of an actuating member of the nozzle arrangement of FIG. 1 in a quiescent condition.
Figure 7:
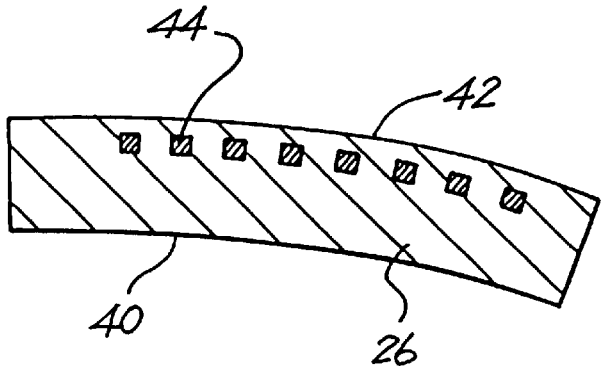
FIG. 7 shows a schematic view of the actuating member in an operative condition.

The nozzle arrangement 10 includes an actuating mechanism in the form of a heater element 44 positioned in each actuating member 26 proximate the outer major face 42. The heater elements 44 are each connected to drive circuitry within the drive circuitry layer 18. The heater elements 44 are configured to be heated when a current is set up in the heater elements 44 via the drive circuitry layer 18. As a result, a portion of each actuating member 26 proximate the outer major face 42 is heated and therefore expands to a greater extent than a remainder of the actuating member 26. This results in the actuating member 26 bending inwardly. In FIG. 6, the actuating member 26 is shown in a condition prior to activation of the heater element 44. In FIG. 7, the heater element 44 has been activated resulting in the bending, as described above.

Figure 3:
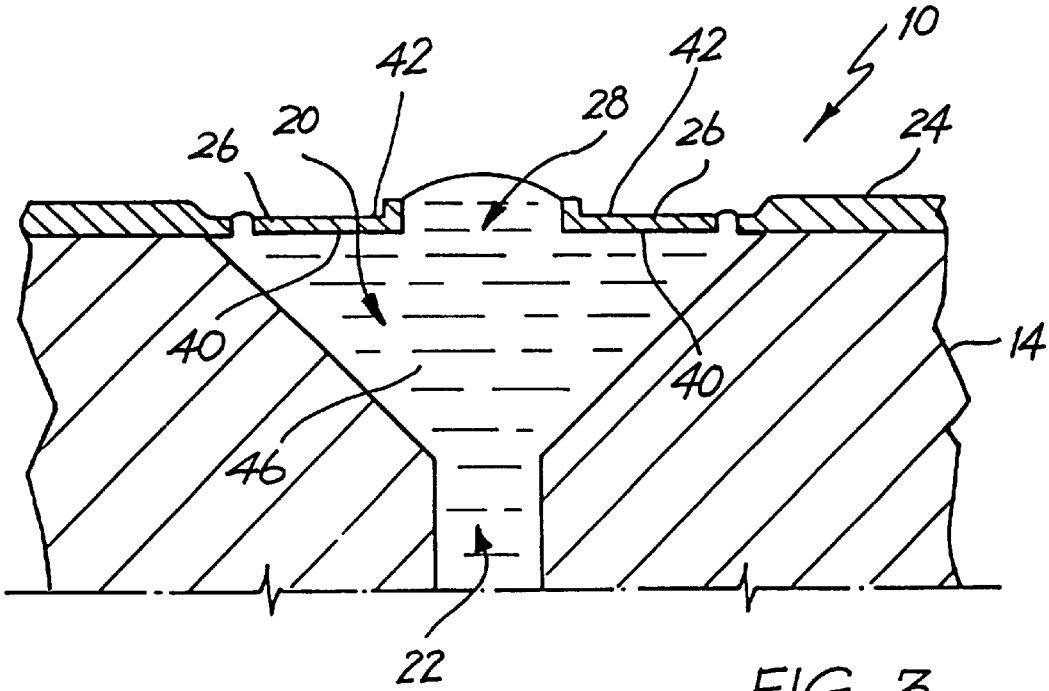
FIG. 3 shows a schematic view of the nozzle arrangement of FIG. 1 in a quiescent condition.
Figure 4:
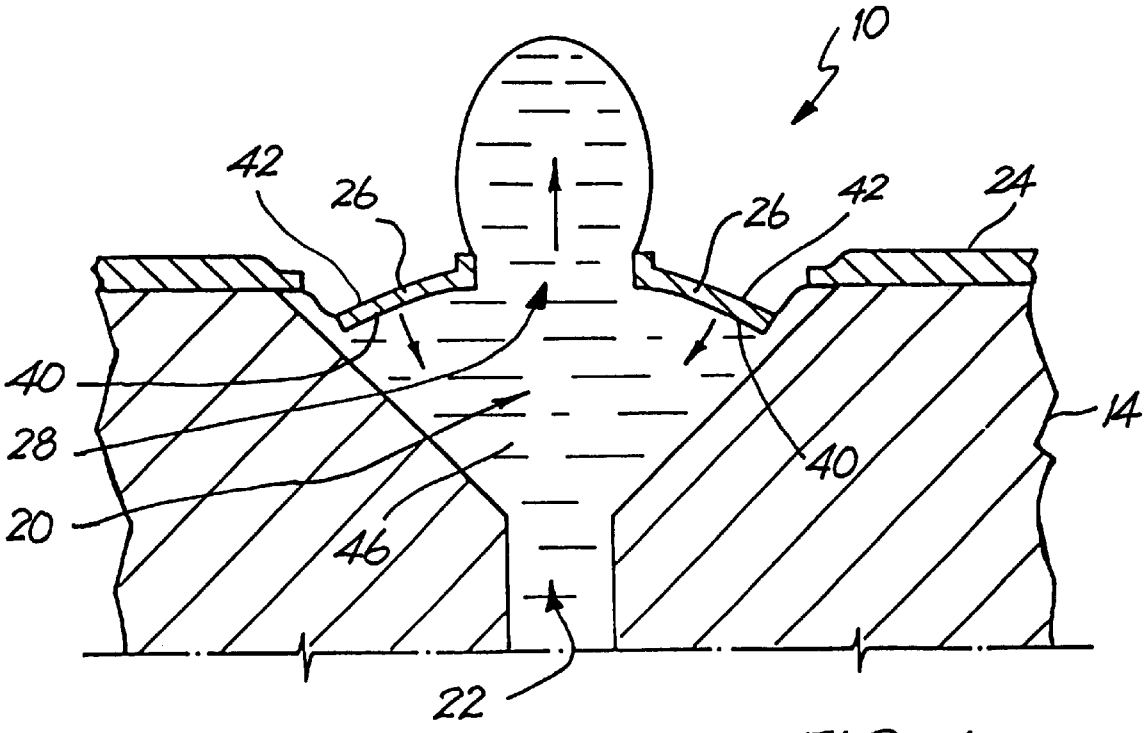
FIG. 4 shows a schematic view of the nozzle arrangement of FIG. 4 in an intermediate operative condition.
Figure 5:
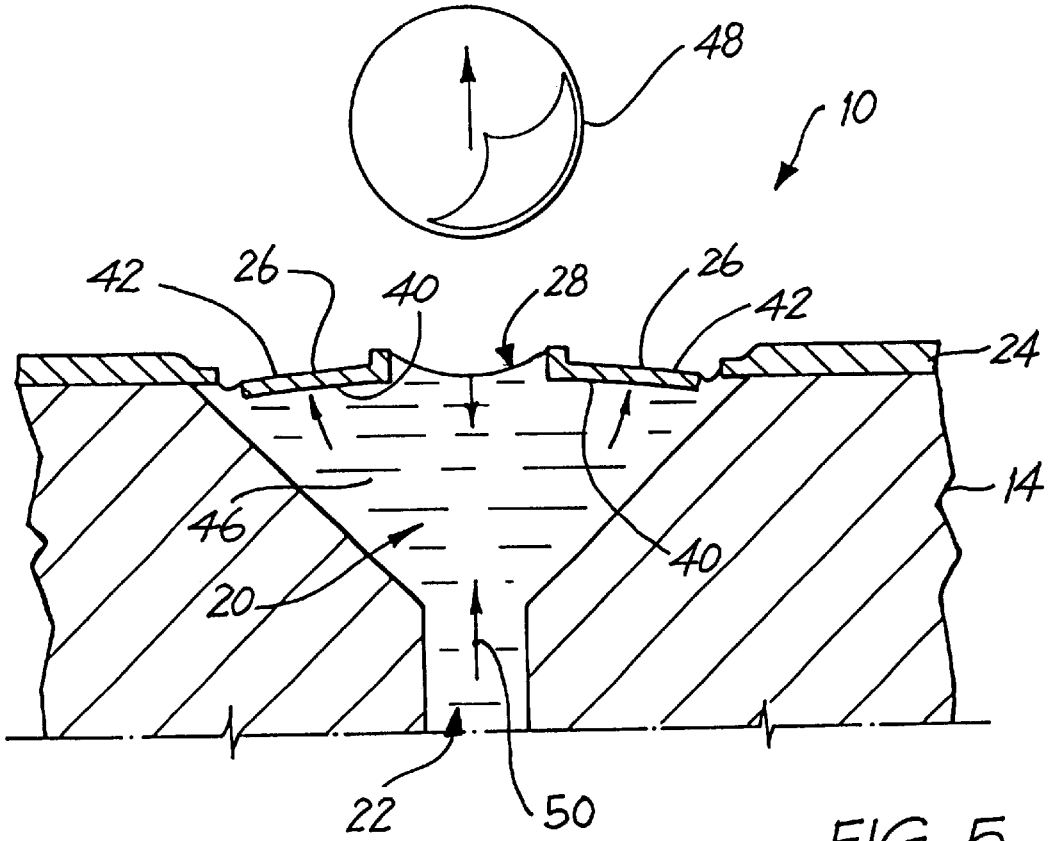
FIG. 5 shows a schematic view of the nozzle arrangement of FIG. 1 immediately subsequent to the ejection of a drop of ink.

Operation of the actuator members 26 is clearly shown in FIGS. 3 to 5. In FIG. 3, the heater elements 44 have not yet been actuated. In this condition, ink 46 fills the ink inlet channel 22 and the nozzle chamber 20.

When the heater elements 44 are activated, the actuating members 26 bend as shown in FIG. 4. As can be seen, this serves to reduce the volume of the nozzle chamber 20 resulting in ink 46 being squeezed from the ink ejection port 28. When the heater elements 44 are de-activated, the actuating members 26 return to their original quiescent condition resulting in a drop of pressure in the nozzle chamber 20. This facilitates separation of ink 46 that has been ejected from the ink ejection port 28 and thus the formation of a drop 48 of the ink 46, as shown in FIG. 5.

On a macroscopic scale, thermal expansion is generally known as a relatively slow process. However, on the microscopic scale on which the nozzle arrangement 10 is manufactured, Applicant has found that thermal expansion and contraction are fast enough to achieve rapid drop ejection and separation.

The expansion material can be selected to have a sufficiently high Young's modulus to achieve a return to a quiescent condition under tension developed in the actuating members 26 while the actuating members 26 are moved into their operative conditions. This facilitates return of the actuating members 26 to their original or quiescent conditions upon cooling of the heater elements 44. An example of a suitable expansion material is polytetrafluoroethylene (PTFE).

Figure 8:
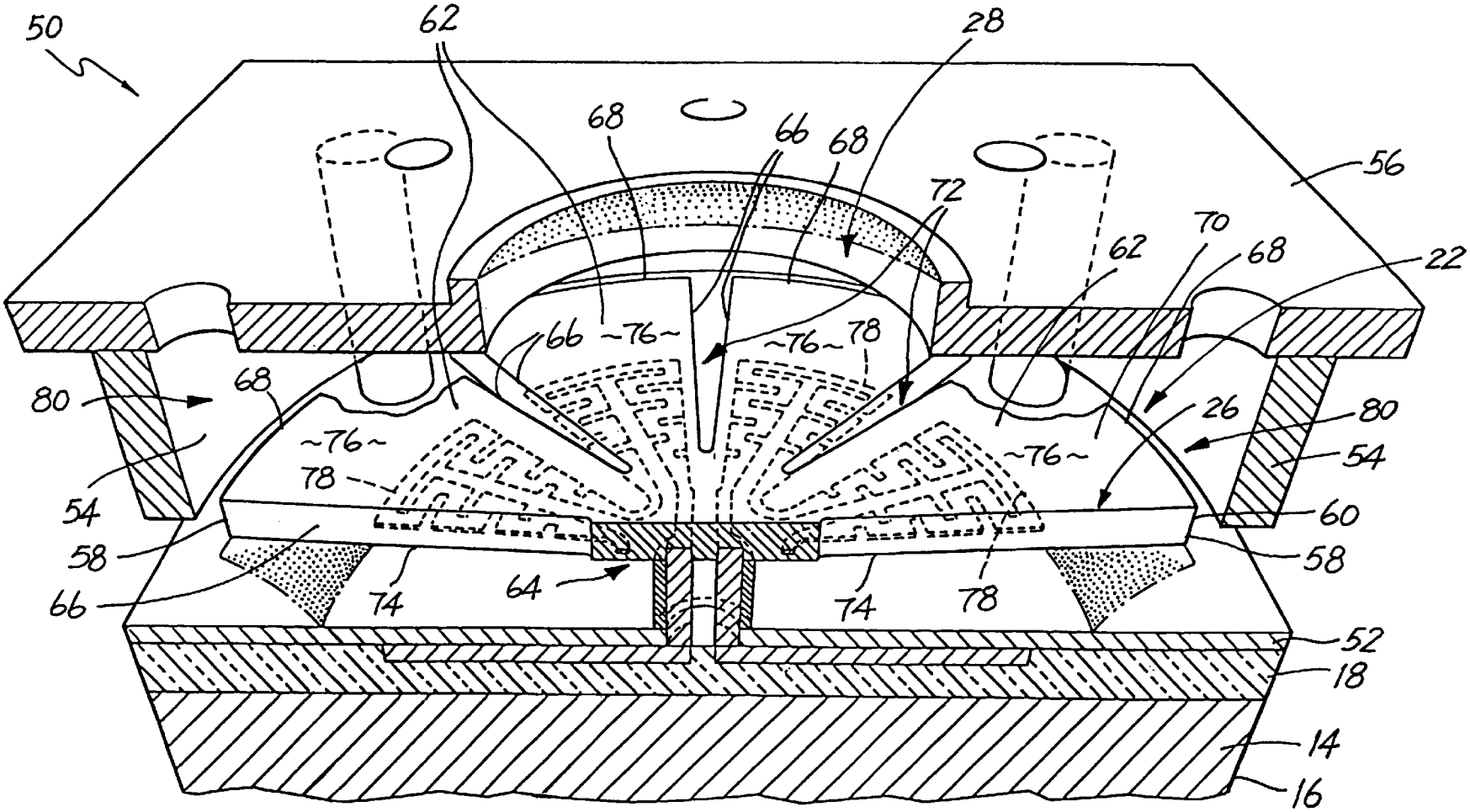
FIG. 8 shows a sectioned three dimensional view of a second embodiment of a nozzle arrangement, for an ink jet printhead, in a quiescent condition.
Figure 9:
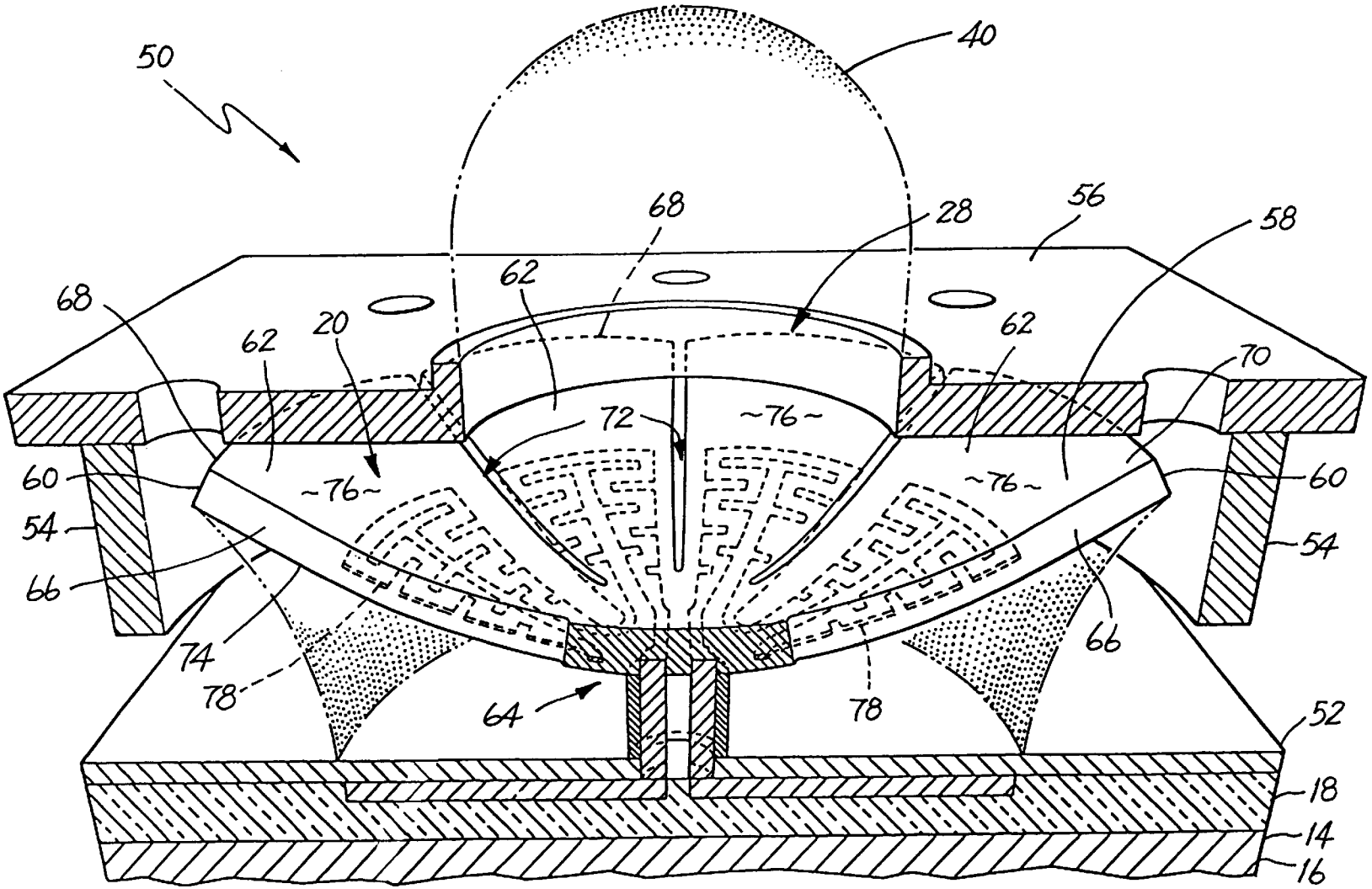
FIG. 9 shows a sectioned three dimensional view of the nozzle arrangement of FIG. 8 in an operative condition.

In FIGS. 8 and 9, reference numeral 50 generally indicates a second embodiment of a nozzle arrangement, in accordance with the invention, for an ink jet printhead. With reference to FIGS. 1 to 7, like reference numerals refer to like parts, unless otherwise specified.

The nozzle arrangement 50 includes an ink passivation layer 52 arranged on the drive circuitry layer 18. A side wall 54 is positioned on the ink passivation layer 52. Further, a roof wall 56 is positioned on the side wall 54 so that the walls 54, 56 define the nozzle chamber 20.

The ink ejection port 28 is defined in the roof wall 56. A floor 58 of the nozzle chamber 20 is defined by a layer 60 of expansion material which is etched to define actuating members 62. A central portion 64 of the layer 60 is anchored to the passivation layer 52. The layer 60 is etched so that each actuating member 26 has a pair of sides 66 which extend radially from the central portion 64. Each actuating member 62 terminates at an arcuate end 68. As can be seen in the drawings, the actuating members 62 define a circular structure 70. Furthermore, adjacent sides 66 of consecutive actuating members 62 define wedge shaped gaps 72 to accommodate bending movement of the actuating members 62 towards the roof wall 56.

Each actuating member 62 has a first major face 74 which is directed towards the ink passivation layer 52 and a second major face 76 which is directed towards the roof wall 56.

The nozzle arrangement 50 includes an actuating mechanism in the form of a heater element 78 positioned in each of the actuating members 62. Each heater element 78 is electrically connected to the drive circuitry layer 18. Further, each heater element 78 is configured to be heated when a current is set up in the heater elements 78 via drive circuitry in the drive circuitry layer 18.

The heater element 78 is positioned proximate the first major face 74. Thus, heating of the heater element 78 results in the heating of the expansion material in each actuating member 62 at a region proximate the first major face 74. This results in the expansion material proximate the first major face 74 expanding to a greater extent than the remainder of the material of the actuating members 62. This results in bending of the actuating members 62 as shown in FIG. 9. As can be seen in FIG. 9, this bending results in a reduction of the volume of the nozzle chamber 20 and the ejection of the ink 46 from the ink ejection port 28.

De-activation of the heater elements 78 results in a cooling of the actuating members 62. This results in a return of the actuating members 62 to the condition shown in FIG. 8 with a resultant inflow of ink through a region 80 defined between the actuating members 62 and the roof wall 56.

Applicant has found that the use of the configuration of actuating members to reduce a volume of a nozzle chamber is an efficient means of ejecting ink from the ink ejection port. Further, as the actuating members return to their inoperative conditions, separation of ink drops is achieved consistently and efficiently.

As is clear with both the above examples, return of the actuators to their inoperative conditions results in ink being drawn back into the nozzle chamber. Applicant has found that using the actuators to reduce the volume of ink in the nozzle chamber results in a highly efficient refilling of the nozzle chamber when the actuators return to their inoperative conditions.

As set out in the preamble, this form of printhead 12 is manufactured in accordance with an integrated circuit fabrication technique. As is known, such techniques involve the deposition and subsequent etching of consecutive layers of specially selected materials. The nozzle arrangements 10, 80 of this invention are particularly suited to such layered construction. Thus, cost of fabrication of the printhead 12 can be maintained at an acceptable level.

I claim:

1. A nozzle arrangement for an ink jet printhead, the nozzle arrangement comprising a chip wafer substrate that incorporates drive circuitry;

a roof wall, side walls and a floor that define a nozzle chamber; and an actuator that is arranged on the substrate for facilitating the ejection of ink from the nozzle chamber of the nozzle arrangement, the actuator comprising at least one micro-electromachanical actuating member that is mounted on the substrate and is operatively positioned with respect to the nozzle chamber to define at least part of one of the roof wall, floor and side walls of the nozzle chamber, the, or each, actuating member being connected to the drive cicuitry layer to be heated when an electrical signal is received from the drive circuitry layer, and the, or each, actuating member being at least partially made up of a material that is capable of expansion to an extent sufficient to perform work when heated and being configured so that, upon such heating, the, or each, actuating member undergoes deformation as a result of such expansion to be displaceable between an inoperative condition and an operative condition to reduce a volume of the nozzle chamber so that ink is ejected from the nozzle chamber; and an actuating mechanism for displacing the, or each, actuating member between the inoperative and operative conditions.

2. A nozzle arrangement as claimed in claim 1, in which the substrate includes a wafer substrate and the drive circuitry layer that is positioned on the wafer substrate.

3. A nozzle arrangement as claimed in claim 2, in which the actuator includes a plurality of actuating members.

4. A nozzle arrangement as claimed in claim 3, in which the wafer substrate defines the side walls of the nozzle chamber which are the product of an etching process carried out on the wafer substrate and the actuating members together partially define the roof wall of the nozzle chamber, the actuating members being displaceable into the nozzle chamber to reduce the volume of the nozzle chamber.

5. A nozzle arrangement as claimed in claim 4, in which a layer of expansion material is positioned on the drive circuitry layer, the layer of expansion material spanning the nozzle chamber and defining the roof wall of the nozzle chamber so that the actuating members are comprised of the expansion material, the actuating members being positioned radially about an ink ejection port defined in the expansion material which has a coefficient of thermal expansion which is such that the material is capable of expansion on the application of heat to an extent that is sufficient to perform work.

6. A nozzle arrangement as claimed in claim 5, in which each actuating member has a pair of radially extending sides, free arcuate ends and opposed inner and outer faces so that the actuating members together define a circular structure.

7. A nozzle arrangement as claimed in claim 6, in which the actuating mechanism includes a heating element that is positioned in each of the actuating members, each heating element being positioned proximate the outer face of its respective actuating member, electrically connected to the drive circuitry layer and capable of being resistively heated as a result of an electrical current set up via the drive circuitry layer so that a portion of each actuating member proximate the outer face is heated and thus expands to a greater extent than a remainder of the actuating member, resulting in each actuating member bending inwardly to reduce the volume of the nozzle chamber so that ink is ejected from the ink ejection port.

8. A nozzle arrangement as claimed in claim 3, in which an ink passivation layer is positioned on the drive circuitry layer and nozzle chamber walls and the roof wall are positioned on the ink passivation layer to define the nozzle chamber, the roof wall defining an ink ejection port.

9. A nozzle arrangement as claimed in claim 8, in which the actuating members are positioned in the nozzle chamber and on the ink passivation layer, to define the floor of the nozzle chamber, the actuating members being displaceable towards the roof wall from an inoperative condition into an operative condition to reduce the volume of the nozzle chamber.

10. A nozzle arrangement as claimed in claim 9, in which the actuating members are defined by a layer of expansion material that is positioned on the passivation layer and is formed so that the actuating members extend radially from a central anchored portion, the expansion material having a coefficient of thermal expansion which is such that the material is capable of expansion on the application of heat to an extent that is sufficient to perform work.

11. A nozzle arrangement as claimed in claim 9, in which the actuating members each have a pair of radially extending sides, a first major face directed towards the passivation layer, a second, opposed major face and a free, arcuate end so that the actuating members together define a circular structure.

12. A nozzle arrangement as claimed in claim 11, in which the actuating mechanism is in the form of a heater element positioned in each of the actuating members proximate the first major face and electrically connected to the drive circuitry layer, so that, when a current is set up in the heater element, a portion of the actuating member proximate the first major face is heated and therefore expands to a greater degree than a remainder of the actuating member, resulting in the actuating member bending towards the roof wall and thus reducing the volume of the nozzle chamber to eject ink from the ink ejection port.

13. An ink jet printhead which comprises a substrate; and a plurality of nozzle arrangements positioned on the substrate, each nozzle arrangement comprising a roof wall, floor and side walls that define a nozzle chamber; and an actuator that is arranged on the substrate for facilitating the ejection of ink from the nozzle chamber of the nozzle arrangement, the actuator comprising at least one micro-electromechanical actuating member that is mounted on the substrate and is operatively positioned with respect to the nozzle chamber to define at least part of one of the roof wall, floor and side walls of the nozzle chamber, the, or each, actuating member being connected to the drive circuitry layer to be heated when an electrical signal is received from the drive circuitry layer, and the, or each, actuating member being at least partially made up of a material that is capable of expansion to an extent sufficient to perform work when heated and being configured so that, upon such heating, the, or each, actuating member undergoes deformation as a result of such expansion to be displaceable between an inoperative condition and an operative condition to reduce a volume of the nozzle chamber so that ink is ejected from the nozzle chamber; and an actuating mechanism for displacing the, or each, actuating member between the inoperative and operative conditions.

* * * * *